United States Patent [19]

Strandli

[11] Patent Number: 4,757,765

[45] Date of Patent: Jul. 19, 1988

[54] ROTATIONAL PROJECTILE

[76] Inventor: Kåre R. Strandli, Lyngveien 5, 2830 Raufoss, Norway

[21] Appl. No.: 49,990

[22] Filed: May 15, 1987

[30] Foreign Application Priority Data

May 16, 1986 [NO] Norway ..... 861947

[51] Int. Cl.[4] ..... F42B 13/02

[52] U.S. Cl. ..... 102/477; 102/204; 102/272; 102/499; 102/705

[58] Field of Search ..... 102/477, 705, 487, 488, 102/473, 272, 204

[56] References Cited

U.S. PATENT DOCUMENTS

| | | | |
|---|---|---|---|
| 287,924 | 11/1883 | Gruson et al. | 102/477 |
| 325,538 | 9/1885 | Hayes | 102/477 |
| 375,190 | 12/1887 | Palmer | 102/477 |
| 612,495 | 10/1898 | Hathaway | 102/477 |
| 639,214 | 12/1899 | Coleman | 102/477 |
| 878,369 | 2/1908 | Finster | 102/477 |
| 1,045,671 | 11/1912 | Bureau | 102/477 |
| 3,599,570 | 8/1971 | Ingersoll et al. | 102/499 |
| 4,140,059 | 2/1979 | Strandli | 102/477 |

*Primary Examiner*—David H. Brown
*Attorney, Agent, or Firm*—Bacon & Thomas

[57] ABSTRACT

A rotational projectile having a hollow, metallic nose portion (1) containing a charge adapted to detonate by impact against a target without the use of a fuse, whereby the nose portion, rearwardly of either a detonatable charge (2) or a component of such a charge, contains a second component (3) situated in an axially through-going and forwardly diverging channel (5) in a non-metallic insert (4) in the nose portion (1).

4 Claims, 2 Drawing Sheets

ROTATIONAL PROJECTILE

BACKGROUND OF THE INVENTION

The present invention relates to a rotational projectile having a hollow metallic nose portion which contains a charge adapted to detonate by impact against a target without the use of any fuse.

When such a projectile is launched from a weapon, for instance a gun or cannon, it is of importance that a complete conversion of the charge or charges does not take place in case the projectile inadvertently hits an item relatively near the weapon. A conversion near the weapon of course involves a great danger of damaging the weapon and injuring the operator or operators of the weapon.

It is known to secure projectiles against complete conversion near the weapon by use of mechanical means inside the projectile. Such mechanical means have, however, and in particular for small caliber projectiles, been found to increase the costs to an unacceptable extent. The object of the present invention is to achieve a projectile which without the use of mechanical means is secured against complete conversion by impact near the weapon.

The above object is achieved with a projectile as defined in the succeeding claims.

The invention is based upon the utilization of centrifugal forces caused by the rotation of the projectile in order to cause a forwardly directed force which tends to displace the component situated in the insert forwardly.

In order to explain the invention it is considered necessary to make a review of the accelerations, retardations and inertia forces occurring during the launching of a projectile from a weapon.

The linear accelerations during launching of projectiles for which the invention is most likely to be used lies in the range of 20,000 to 120,000 G, and gives rise to large forces which tend to displace charges or components of charges rearwardly inside the projectile as long as the thrust from the propellant charge acts on the projectile in the gun barrel.

When the projectile leaves the weapon it will be retarded in its path because of the air resistance, and the retardation may be in the order of 50 G.

Those parts of charges or components of charges that are situated in a relatively large radial distance from the longitudinal axis of the projectile will, due to the rotation of the projectile, be exposed to centrifugal forces which are equivalent to accelerations being substantially larger than the retardation. The centripetal accelerations may for instance be in the order of 1,000 G.

SUMMARY OF THE INVENTION

According to the invention a component of a charge is situated in an axially through-going and forwardly diverging channel in a non-metallic insert in the nose portion. This component is a per se not explosive or not detonatable part of a charge.

By launching, and before the projectile hits a target in a reasonably large distance from the weapon (a distance being at least so large that a complete conversion of the projectile charge or charges cannot damage the weapon or injure the operator or operators thereof) the following will take place, provided that the projectile has been adapted to and optimized for the particular launching system being used.

During the launching the components and possible charges are forced rearwardly relatively to the remainder of the projectile, and a cavity is formed forwardmost in the nose portion.

The rotation of the projectile causes a centrifugal force which pushes the component situated in the insert towards the forwardly diverging channel in the insert. The centrifugal force has a force component directed along the wall of the channel, in an inclined forward direction. The retardation of the projectile (due to the air resistance) causes a force tending to displace the charges and the components forwardly in the projectile, and this force, consequently, has a force component directed forwardly along the channel wall. Thus, the force components along the channel wall will sum up. Those elements of the charge component which are not in contact with the channel wall will, to the contrary, merely be exposed to the retardation force and the centrifugal force and will move slantingly forwardly and outwardly towards the channel wall. Because of the forward movement of the elements which come into contact with the channel wall a free space will be formed along the wall, and other such elements come successively into contact with the wall and are moved therealong. Thereby, an axial aperture is formed in the component situated in the channel.

Forwardmost in the nose portion is, prior to launching, situated either a pre-mixed forward charge which detonates upon impact, or a component of such a charge, whereby said component is mixed together with a second component while the projectile is rotating in its path, and forms a charge which detonates upon impact against a target. The two components are mixed because the second component is forced forwardly. The forward charge is mixed before the projectile reaches the target. The detonation upon impact will propagate rearwardly to possible other charges.

During the acceleration by the launching the components and possible pre-mixed charges will be compressed, but the compressing will not prevent the second component in moving forwardly when the projectile is in its path.

If the projectile does not reach the target, but hits an obstacle relatively near the weapon, safety against complete conversion is achieved in a plurality of ways.

The said cavity forwardmost in the nose portion is created during the acceleration inside the barrel of the weapon. If the forward component is situated behind the cavity, the nose portion contains two components which are not mixed together and which are not capable of detonating independently of each other. One of the components may for instance be a metal (fuel) while the second component contains chemically bound oxygen. Thus, both the components are "cold", but form an explosive in a mixed state.

The cavity forwardmost in the nose portion may have such an axial extension that the nose portion by inadvertent impacts is not deformed further rearward than the cavity. Such a limited deformation is likely to take place if the projectile hits a lightweight obstruction.

By deformation further rearward, in the portion where the forward component is situated, the forward component will not burst.

If the deformation is extended to the transition zone between the components conversion may take place in this zone, but the pyrotechnical chain rearwardly is broken because of the second component. The nose portion may be torn up, but no bursting of the charge situated further rearwardly in the projectile will take place.

The safety achieved with the invention is based on the fact that it takes some time to form the aperture through the second component inside the insert. The forming of such an aperture necessitates a high speed rotation, and the invention involves that the projectile will not detonate in drop tests, provided that the nose portion contains two components which cannot detonate prior to being mixed together.

BRIEF DESCRIPTION OF THE DRAWING

The invention will in the following be explained more in detail, by means of an example, with reference to the accompanying drawings.

DETAILED DESCRIPTION OF THE INVENTION

Figure 1:
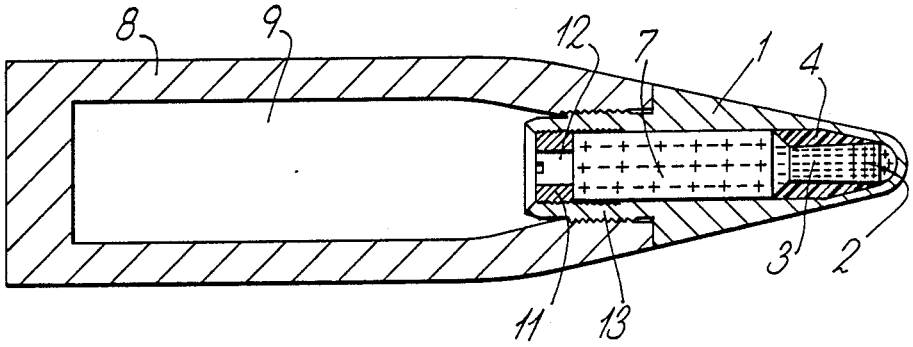
FIG. 1 shows a longitudinal section through a projectile according to the invention.

The projectile shown in FIG. 1 comprises a projectile body 8 having a cavity 9 which may contain one or more charges constituting the main charges of the projectile. A hollow nose portion 1 of metal has a threaded sleeve portion 13, with which it has been screwed into the projectile body 8. A disc 11 having a central opening 12 is screwed into the sleeve portion 13. The disc 11 acts as a supporting disc during the launching, in order to prevent a charge disposed 7 in the nose portion from being displaced rearwardly. Forewardly of the charge 7 is an insert 4, in the form of an element of revolution, having a central axial channel 5 (shown in FIGS. 3 and 4), and the insert terminates in a certain distance from the forwardmost end of the cavity in the nose portion 1. The channel 5 diverges forwardly, and may for instance be conical. The insert is shown as having a rearward cavity which diverges rearwardly but this is of no fundamental importance.

Prior to launching of the projectile two charge components 2 and 3 may be situated in the nose portion in the manner shown in FIG. 1, one behind the other. The components 2 and 3 may be of such a composition that one component cannot detonate independently of the other. Alternatively the forwardmost component may be replaced by a charge capable of detonating.

Figure 2:
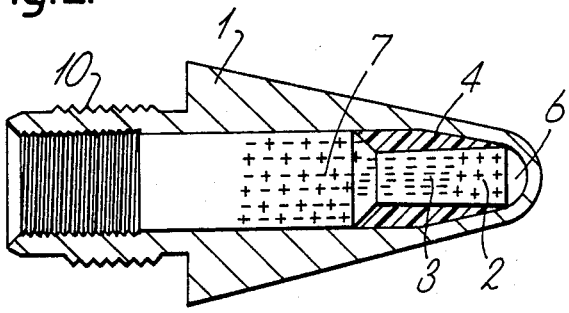
FIG. 2 shows, in a larger scale, a longitudinal section through a nose portion of the projectile.

In both instances the charge or component 2 and the component 3 will be compressed by the inertia forces during the launching, and a small cavity 6 is formed forwardmost in the nose portion 1, as shown in FIG. 2. If the projectile in this condition, i.e. while the charge or component 2 and the component 3 are situated one behind the other, hits an item, the charge 2 will detonate. When being merely a component it will not detonate. In the first instance the pyrotechnical chain will be broken by the component 3.

When the forward component 2 is "cold" a detonation can only take place in the transition zone between the components 2 and 3. The pyrotechnical chain will be broken by the component 3.

If the projectile does not hit an item near the weapon from which it is launched the projectile will move in a path while being retarded because of the air resistance. Simultaneously the projectile rotates.

Figure 3:
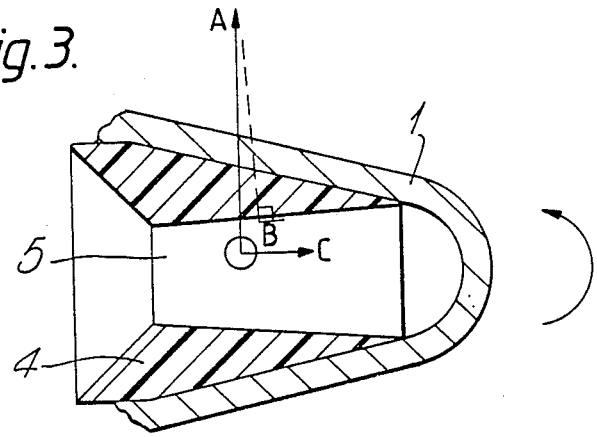
FIG. 3 shows a longitudinal section through the forwardmost end of the nose portion, which comprises an insert, said Fig. illustrating those forces which act upon a charge component situated inside the insert.

FIG. 3 illustrates the forces which act upon an element of the component 3 situated in the insert 4 in a distance from the axis of rotation.

Figure 4:
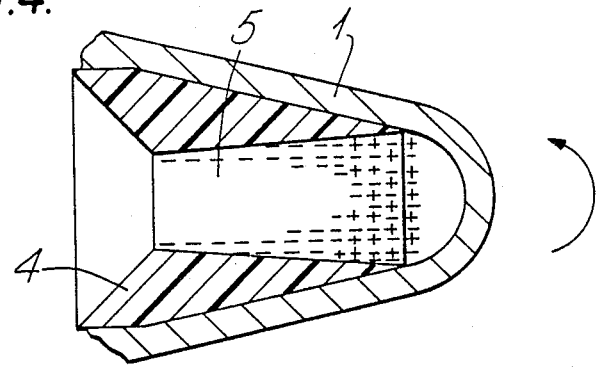
FIG. 4 shows the same longitudinal section as FIG. 3, and illustrates the forming of an aperture in a charge situated in the insert.

The element will be influenced by an inertia force C due to the retarding of the projectile. When the element is in contact with the wall of the channel 5 the conicity of the channel will cause the centripetal force A to have a component B directed along the wall, in a forward direction. Thus, the element will be influenced by forces tending to displace the element forwardly, and these forces are larger than the inertia force due to the retardation. Elements situated along the channel wall, therefore, will be subjected to larger forces in the forward direction than elements situated radially inside of the channel wall. Consequently, a migration of elements will take place along the channel wall, while elements situated rearwardly in the channel will move more or less radially towards the channel wall. The consequence is that an aperture is formed along the axis of the component inside the channel 5, as shown in FIG. 4, and the component will be mixed together with the forward component. Thereby is produced a charge which can detonate by impact against a target. If a charge capable of detonating is initially situated forwardmost in the nose portion the aperture makes it possible for the pyrotechnical chain to propagate rearwardly in the projectile.

The insert 4 is non-metallic. The purpose is to prevent the wall of the channel from acting as a friction surface for the mixed components. A metallic insert might cause inadvertent detonation before the projectile hits a target. The insert 4 may for instance be made of plastics, but other materials such as wood, bakelite and similar may also be used.

I claim:

1. In a rotational projectile of the type including a hollow metallic nose portion having a cavity for containing a charge detonatable by impact against a target without the requirement of a fuse, the improvement comprising:

(a) a non-metallic insert disposed in the nose portion of the projectile, the insert including an axially disposed channel diverging forwardly towards the front end of the nose portion;

(b) a first charge component disposed in a forward position within the channel and a second charge component disposed in a rearward position behind the first charge component within the channel;

(c) the first charge component being either a grainy and detonatable charge or a component of a grainy and detonatable charge;

(d) the second charge component including a grainy non-detonatable component of a charge; and (e) the first and second charge components being compressible.

2. The projectile of claim 1 further including a detonatable explosive charge disposed rearwardly behind the non-metallic insert.

3. The projectile of claim 1 wherein the non-metallic insert is positioned at a distance rearwardly from the front end of the cavity.

4. The projectile of claim 1 wherein the non-metallic insert is pressed into the cavity.

* * * * *